United States Patent [19]

Brown

[11] Patent Number: 4,749,343

[45] Date of Patent: Jun. 7, 1988

[54] HIGH PRESSURE FLUID PUMP

[75] Inventor: Ralph V. Brown, Cayuta, N.Y.

[73] Assignee: Facet Enterprises, Inc., Tulsa, Okla.

[21] Appl. No.: 894,336

[22] Filed: Aug. 8, 1986

[51] Int. Cl.[4] ..... F04B 17/04

[52] U.S. Cl. ..... 417/417; 417/552

[58] Field of Search ..... 417/417, 410, 552, 388, 417/269, 259, 550, 567, 572; 137/543.17

[56] References Cited

U.S. PATENT DOCUMENTS

| | | | |
|---|---|---|---|
| 1,717,856 | 6/1929 | Smith | 137/543.17 |
| 4,040,442 | 8/1977 | Alexandre | 137/543.17 |
| 4,049,017 | 9/1977 | Jones | 137/543.17 |
| 4,169,696 | 10/1979 | Brown | 417/417 |

*Primary Examiner*—Carlton R. Croyle
*Assistant Examiner*—Timothy S. Thorpe
*Attorney, Agent, or Firm*—James R. Ignatowksi; Remy J. VanOphem

[57] ABSTRACT

A high pressure fluid pump having a telescoping cylinder assembly disposed in a cylindrical sleeve. The telescoping cylinder assembly has a stationary member rigidly attached to the cylindrical sleeve and a telescoping member biased towards an outlet port. The telescoping member is reciprocated relative to the stationary member by the displacement of an armature in response to the intermittent energizing of a solenoid coil. An inlet valve connected to the telescoping member and an outlet valve connected to the stationary member provide a unidirectional fluid flow through the telescoping cylinder assembly with the reciprocation of the telescoping member. The outlet valve has a flat valve member which is biased against a valve seat provided at the end of the stationary member adjacent to the outlet port. The flat valve member is preferably made from a resilient elastomer which increases the efficiency of the pump and eliminates forward and back syphoning.

12 Claims, 1 Drawing Sheet

HIGH PRESSURE FLUID PUMP

BACKGROUND OF THE INVENTION

1. Field Of The Invention

The invention is related to electrically actuated fluid pumps and in particular to electromagnetic reciprocating fluid pumps.

2. Description of the Prior Art

In U.S. Pat. No. 4,169,696 I have disclosed a high pressure fluid pump having a pair of telescoping cylinders axially disposed in a pump cavity. Conical stem valves disposed at the opposing ends of the telescoping cylinders produce a unidirectional fluid flow through the pump as the telescoping cylinders are reciprocated relative to each other by a solenoid driven armature. Although this pump works well, the unit-to-unit variations in its performance characteristics have been excessive. The invention is a high pressure pump of the type disclosed in U.S. Pat. No. 4,169,696, in which the variation in the unit-to-unit performance characteristics has been substantially reduced.

SUMMARY OF THE INVENTION

The invention is a high pressure fluid pump having a housing which consists of an inlet member having an inlet port, an outlet member having an outlet port, and a cylindrical sleeve connecting the inlet and outlet members. A telescoping cylinder assembly having a stationary member and a telescoping member are disposed in the cylindrical sleeve. The stationary member has a cylindrical portion and a radial flange brazed to the cylindrical sleeve at the end adjacent to the outlet port. The telescoping member has a cylindrical portion and a radial flange slidably received in the cylindrical sleeve. One of the cylindrical portions of the stationary and telescoping members is slidably received in the other. A magnetically permeable cylindrical armature is disposed in the cylindrical sleeve circumscribing the cylindrical portions of the stationary and telescoping members between the radial flanges. A resilient means, such as a coil spring, is provided for biasing the telescoping member and the armature towards the outlet port. A solenoid coil circumscribing the cylindrical sleeve is provided for generating a magnetic field operative to displace the armature towards the inlet port. The armature engages the radial flange of the telescoping member and displaces it toward the inlet port. Inlet valve means are attached to the end of the telescoping member adjacent to the inlet port. The inlet valve means is actuated to an open position in response to the telescoping member being displaced towards the inlet port. Outlet valve means, having a flat elastomeric valve member, is disposed at the end of the stationary member adjacent to the outlet port. The flat elastomeric valve member is resiliently biased to seal the opening of the stationary member's cylindrical portion and is displaced to an open position in response to the fluid pressure inside the cylindrical portion of the stationary member exceeding a predetermined value.

The object of the invention is a high pressure fluid pump in which the unit-to-unit variations are minimized. Another object of the invention is a high pressure fluid pump with improved suction and efficiency. Still another object of the invention is a high pressure fluid pump having anti-syphon characteristics. These and other objects of the invention will become more apparent from reading the detailed description in conjunction with the appended figures.

DETAILED DESCRIPTION OF THE INVENTION

Figure 1:
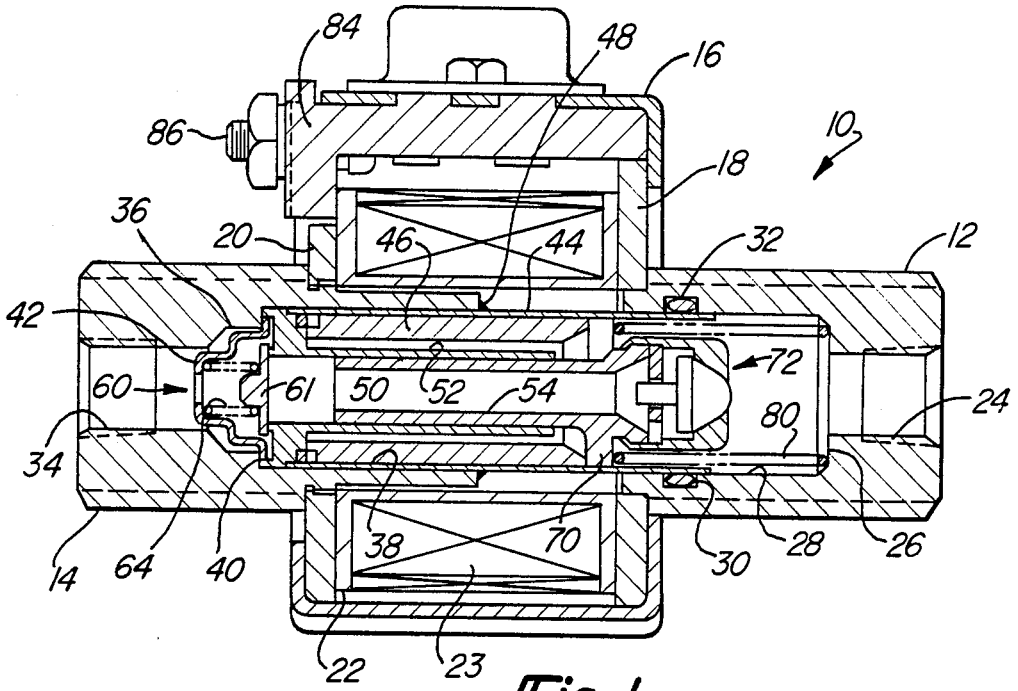
FIG. 1 is a cross-sectional side view of the entire electromagnetic fluid pump.

The details of a high pressure fluid pump 10 are shown in FIG. 1, which is a cross-section of the pump taken along its longitudinal axis. As shown, the pump 10 has an inlet housing member 12, an outlet housing member 14, and an intermediate housing member 16. The inlet housing member 12 is fixedly attached to an annular pole member 18 and the outlet housing member 14 is threadably attached to a second annular pole member 20 coaxial with the inlet housing member 12. A solenoid coil assembly 22 having a solenoid coil 23, is clamped between the pole members 18 and 20 by the intermediate housing member 16.

The inlet housing member 12 may be pressed into an aperture formed in the annular pole member 18, as shown, or may be threadably mounted, soldered, brazed, welded, or otherwise secured to the pole member 18. The inlet housing member 12 has a threaded inlet port 24, an internal spring seat 26 circumscribing the inlet port 24, and a cylindrical bore 28. A groove 30 recessed about the cylindrical bore 28 of the inlet housing member 12 a short distance from its internal end receives a seal, such as an O-ring 32 or any other type of seal packing, as is known in the art.

The outlet housing member 14 has a threaded outlet port 34, a clearance bore 36 and a cylindrical bore 38. An annular shoulder 40 formed between the clearance bore 36 and the cylindrical bore 38 forms a seat for the radial flange of a cup-shaped retainer 42. A nonmagnetic cylindrical sleeve 44 having one end disposed in the outlet housing member's cylindrical bore 38 and the other end disposed in the inlet housing member's cylindrical bore 28 form a guide for the reciprocation of a hollow cylindrical armature 46. The cylindrical sleeve 44 is fixedly attached to the outlet housing member 14 by an annular seal 48 provided about the circumference of the cylindrical sleeve 44 adjacent to the internal end of the outlet housing member 14. In the preferred embodiment the annular seal 48 is a silver solder brazed seal, but may be a welded seal or any other type of seal which would provide a mechanically rigid fluid-tight connection between the cylindrical sleeve 44 and the outlet housing member 14. The O-ring 32 provides a fluid-tight seal between the opposite end of the cylindrical sleeve 44 and the inlet housing member 12. The inlet housing member 12, outlet housing member 14, and cylindrical sleeve 44 together make up the fluid housing of the pump.

Figure 2:
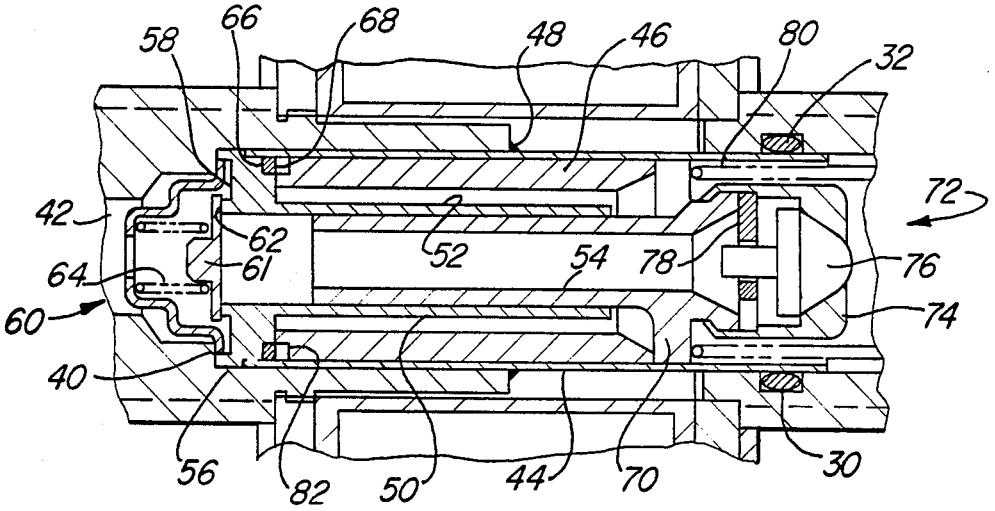
FIG. 2 is a partial cross-sectional side view showing the details of the telescoping cylinders and the inlet and outlet valve.

As more clearly shown in FIG. 2, a telescoping cylinder assembly 50, having a stationary member 52 and a telescoping member 54, is disposed in the cylindrical sleeve 44. The stationary member 52 of the telescoping cylinder assembly 50 has a cylindrical portion extending axially inside of the cylindrical armature 46 and a radial flange 56 fixedly attached to the cylindrical sleeve 44 at the end adjacent to the outlet port 34. The telescoping member 54 has a cylindrical portion slidably received in the cylindrical portion of the stationary member 52 and a segmented radial flange 70 slidably received in the cylindrical sleeve 44. The cylindrical armature 46 is captivated between the radial flanges 56 and 70. As is shown alternatively in U.S. Pat. No. 4,169,696, the cylindrical portion of the stationary member 52 may be received in the cylindrical portion of the telescoping member 54. A close tolerance slip fit between the external surfaces of the cylindrical portion of the telescoping member 54 and the internal surface of the cylindrical portion of the stationary member 52 permit the telescoping member 54 to slide freely within the stationary member 52 yet provide a long, narrow, high resistant fluid leakage path for the fluid being pumped. This fluid leakage is considerably less than that encountered in the prior art pumps, and is one of the features which permit this pump to generate higher pressure.

The radial flange 56 of the stationary member 52 has a peripheral undercut or notch 66 provided on the face adjacent to the cylindrical armature 46. A silver solder braze 68 formed in the peripheral notch 66 rigidly attaches the stationary member 52 to the cylindrical sleeve 44 and maintains the axis of the cylindrical portion of the stationary member 52 parallel to the axis of the cylindrical sleeve 44. An annular recess 58 provided on the other face of the radial flange 56 produces a raised valve seat 62 for an outlet valve assembly 60 which consists of a flat valve member 61, a compressed coil spring 64 and the cup-shaped retainer 42. One end of the coil spring 64 is captivated in the cup portion of the retainer 42 and the other end engages the backside of the flat valve member 61. The compressed coil spring 64 produces a force urging the valve member 61 against the valve seat 62. The valve member 61 is preferably made from an elastomer, such as VITRON®. The flange provided about the rim of the cup-shaped retainer 42 is captivated in the annular recess 58 between the radial flange 56 and annular shoulder 40 and is biased against the annular shoulder 40 of the outlet housing member 14 rim portion by the coil spring 64, as shown.

An inlet valve assembly 72 is attached to the telescoping member 54 at the end adjacent to the inlet port 24. The inlet valve assembly 72 consists of a valve seat member 74, a conical stem valve member 76, and a stem guide 78. The inlet valve assembly 72 and the outlet valve assembly 60 cooperate in a known way to provide a unidirectional fluid flow through the telescoping cylinder assembly 50 when the telescoping member 54 is reciprocated.

Returning now to FIG. 1, the cylindrical armature 46 and the telescoping member 54 are urged toward the outlet port 34 by the force produced by a compressed coil spring 80. One end of the coil spring 80 engages the spring seat 26 provided in the inlet housing member 12 and the other end engages the radial flange 70 of the telescoping member 54.

The hollow cylindrical armature 46 is preferably made from a magnetic susceptible ceramic material, such as 3B7 ferrite, manufactured by Ferroxcube Corporation of Saugerties, N.Y., having a significantly higher electrical resistance than metallic or soft iron armatures. The ceramic armature reduces eddy currents in the armature which increases the efficiency of the pump and permits it to be operated at a higher speed. The cylindrical armature 46 has a shallow undercut 82 at the end adjacent to flange 56. The small annular volume formed by the undercut 82 between the cylindrical armature 46 and the radial flange 56 traps a small volume of fluid which acts as a hydraulic cushion for the cylindrical armature as it is urged towards the radial flange 56 by the coil spring 80 acting on the telescoping member 54.

The solenoid coil assembly 22 circumscribes the cylindrical sleeve 44 between the pole members 18 and 20, as previously described. The solenoid coil 23 is intermittently energized by a source of intermittent electrical power mounted on a circuit board 84 to reciprocate the cylindrical armature 46 and the telescoping member 54 relative to the stationary member 52 which produces the desired pumping action. The source of intermittent electrical power may be a blocking oscillator, a multivibrator, an electrical timer, or any other type of circuit known in the art. The electrical power to the source of intermittent electrical power is received at an electrical input terminal 86 from a source of electrical power (not shown).

OPERATION

Briefly, the operation of the pump is as follows:

Upon energizing the source of intermittent electrical power, it will periodically energize the solenoid coil 23 to produce a magnetic field. This magnetic field will displace the cylindrical armature 46 and the telescoping member 54 of the telescoping cylinder assembly 50 towards the inlet port 24 against the force of the coil spring 80. During the displacement of the telescoping member 54, the outlet valve assembly 60 will remain closed and the inlet valve assembly 72 will open, allowing a quantity of fluid received through the inlet port 24 to fill the expanded internal volume between the stationary member 52 and the telescoping member 54. After a period of time, the telescoping member 54 will be fully displaced to a cocked position, and the source of intermittent electrical power will deenergize the solenoid coil 23 terminating the magnetic field. The coil spring will now start to displace the telescoping member 54 and the cylindrical armature 46 towards the outlet port 34. During this displacement of the telescoping member 54, the inlet valve assembly 72 will close and when the pressure of the fluid trapped between the outlet and inlet valve assemblies 60 and 72, respectively, exceeds a value determined by the coil spring 64, the outlet valve assembly 60 will open allowing the excess fluid to flow out through the outlet port as the volume enclosed by the stationary member 52 and telescoping member 54, respectively, decreases. The pumping cycle is completed when the cylindrical armature 46 engages the face of the radial flange 56. At this point, the solenoid coil assembly 22 is re-energized displacing the cylindrical armature 46 and the telescoping member 54 to the cocked position and the pumping cycle is repeated.

The advantages of the disclosed high pressure pump are as follows:

The coil spring 80 works only against the reduced area of the stationary member resulting in a higher fluid pressure at the pump's outlet port 34;

The pressure at the outlet port can be changed by varying the internal diameter of the stationary member without requiring any change to any other component;

The high impedance to the fluid leakage between the stationary and telescoping members of the telescoping cylinder assembly 50 increases the volumetric efficiency of the pump;

The silver solder brazed connections between the stationary member 52, the cylindrical sleeve 44 and outlet housing member 14 produce a structurally rigid assembly which eliminates unit-to-unit variations; and The outlet valve assembly 60 having a flat elastomeric valve member provides an increased outlet flow area and increased efficiency. In particular, the outlet valve assembly 60 produces improved suction and prevents the loss of prime since the closing force is equal to the force generated by the coil spring 64 and the pressure differential between the inlet and outlet ports. The outlet valve assembly also eliminates syphoning through the pump when the utilization device connected to the pump's outlet port is at a pressure lower than the pressure of the fluid source connected to the pump's inlet port, or when both the utilization device and the fluid source are at the same pressure but at different elevations.

Having described the high pressure pump with regard to its preferred embodiment, it is recognized that a person skilled in the art may make changes to its structure without departing from the spirit of the invention. It is not intended that the pump be limited to the configuration illustrated in the drawing and discussed in the specification.

What is claimed is:

1. A high pressure fluid pump comprising:

a housing having an inlet member having an inlet port, an outlet member having an outlet port, and a nonmagnetic cylindrical sleeve connecting said inlet and outlet member;

a telescoping cylinder assembly having a stationary member and a telescoping member disposed in said nonmagnetic cylindrical sleeve, said stationary member having a cylindrical portion, a radial flange brazed to the end of said cylindrical sleeve adjacent to said outlet port, and an annular valve seat provided at the end facing said outlet port, said telescoping member having a cylindrical portion and a segmented radial flange slidably received in said cylindrical sleeve, one of said cylindrical portions of said stationary and telescoping members being slidably received inside of the other;

a magnetially permeable cylindrical armature disposed in said cylindrical sleeve and circumscribing said cylindrical portions of said stationary and telescoping members between said radial flanges;

resilient means for biasing said telescoping member and said armature towards said outlet port;

a solenoid coil for generating a magnetic field operative to displace said armature toward said inlet port, said armature engaging said radial flange of said telescoping member and also displacing said telescoping member towards said inlet port;

inlet valve means attached to the end of said telescoping member adjacent to said inlet port, which is actuated to an open position in response to said telescoping member being displaced toward said inlet port;

a flat elastomer valve member resiliently biased against said annular valve seat;

spring retainer means disposed intermediate said stationary member and said outlet port; and a compressed coil spring disposed between said spring retainer means and said flat elastomer valve member to resiliently bias said flat elastomer valve member against said annular valve seat.

2. The high pressure fluid pump of claim 1 wherein said radial flange of said stationary member has a notch provided about its periphery and wherein the material brazing said stationary member to said cylindrical sleeve is disposed in said notch.

3. The high pressure fluid pump of claim 2 wherein said brazing material is a silver solder.

4. The high pressure fluid pump of claim 1 wherein said cylindrical portion of said telescoping member is received in said cylindrical portion of said stationary member.

5. The high pressure fluid pump of claim 1 wherein the material of said magnetically permeable armature is a magnetically permeable cylindrical ceramic.

6. The high pressure pump of claim 1 including a source of intermittent electrical power for periodically energizing said solenoid coil.

7. In a high pressure fluid pump of the type having a housing defining a cylindrical passage between an inlet port and an outlet port, a stationary member having a radial flange attached to the housing and a cylindrical portion, a telescoping member slidably received in the housing's cylindrical passage, the telescoping member having a cylindrical portion slidably received in the stationary member's cylindrical portion and a segmented radial flange, a magnetically permeable cylindrical armature circumscribing the cylindrical portions of the stationary and telescoping members between the radial flanges, means for resiliently biasing the telescoping member and the armature towards the outlet port, a solenoid coil for generating a magnetic field to displace the armature and telescoping member towards the inlet port, and unidirectional valve means attached to the end of the telescoping member adjacent to the inlet port, the improvement comprising:

a valve seat provided about the cylindrical portion of said stationary member's cylindrical portion adjacent to said outlet port;

a flat elastomer valve member resiliently biased against said valve seat;

a cup-shaped retainer fixedly positioned relative to the end of said stationary member adjacent to said outlet port; and a compressed coil spring having one end disposed in said cupshaped retainer and the other end resiliently biasing said flat elastomer valve member against said valve seat.

8. The improvement of claim 7 wherein said radial flange of said stationary member has an annular recess circumscribing said cylindrical portion, and wherein the non-recessed portion of said stationary member circumscribing said cylindrical portion is said valve seat.

9. The improvement of claim 7 wherein said cylindrical passage of said housing is defined by a cylindrical sleeve, and said radial flange of said stationary member is brazed to said cylindrical sleeve.

10. The improvement of claim 9 wherein said radial flange of said stationary member is brazed to said cylindrical sleeve with a silver solder.

11. The improvement of claim 7 wherein said magnetically permeable cylindrical armature is a ceramic magnetic permeable armature.

12. The improvement of claim 7 including a source of intermittent electrical power for periodically energizing said solenoid coil.

* * * * *

UNITED STATES PATENT AND TRADEMARK OFFICE

CERTIFICATE OF CORRECTION

PATENT NO. : 4,749,343

DATED : June 7, 1988

INVENTOR(S) : Ralph V. Brown

It is certified that error appears in the above-identified patent and that said Letters Patent is hereby corrected as shown below:

Column 6, line 13, after "permeable" insert ---- cylindrical ----.

Column 6, line 45, delete "cupshaped" and insert ---- cup-shaped ----.

Signed and Sealed this

Sixth Day of December, 1988

*Attest:*

DONALD J. QUIGG

*Attesting Officer*

*Commissioner of Patents and Trademarks*